US005144754A

United States Patent [19]

Persson

[11] Patent Number: 5,144,754

[45] Date of Patent: Sep. 8, 1992

[54] METHOD FOR CONTROLLING THE SUPPLY AND THE DISCHARGE OF HOT AIR TO AND FROM, RESPECTIVELY, A BLOWING TUNNEL

[75] Inventor: Anders Persson, Växjö , Sweden

[73] Assignee: ABB Flakt AB, Sweden

[21] Appl. No.: 602,265

[22] PCT Filed: Apr. 27, 1989

[86] PCT No.: PCT/SE89/00237

§ 371 Date: Dec. 27, 1990

§ 102(e) Date: Dec. 27, 1990

[87] PCT Pub. No.: WO89/11074

PCT Pub. Date: Nov. 16, 1989

[30] Foreign Application Priority Data

May 2, 1988 [SE] Sweden ..... 8801648

[51] Int. Cl.[5] ..... F26B 3/00

[52] U.S. Cl. ..... 34/29; 34/44; 34/54; 34/51; 34/233; 34/243 C

[58] Field of Search ..... 34/29, 232, 233, 243 C, 34/43, 44, 54, 51; 118/326, 58, 300; 98/115.2

[56] References Cited

U.S. PATENT DOCUMENTS

| | | | |
|---|---|---|---|
| 2,663,951 | 12/1953 | Kennison | 34/233 |
| 2,761,948 | 9/1956 | Todd | 34/201 |
| 3,367,645 | 2/1968 | Werych | 34/233 |
| 3,805,410 | 4/1974 | Rupp | 34/233 |
| 4,546,553 | 10/1985 | Best | 34/243 C |
| 4,600,491 | 7/1986 | Urquhart et al. | 34/243 C |
| 4,635,381 | 1/1987 | Hubbert | 34/233 |
| 4,656,758 | 4/1987 | Nakayama | 34/243 C |
| 4,761,894 | 8/1988 | Hamasaki et al. | 34/243 C |

*Primary Examiner*—Henry A. Bennet
*Assistant Examiner*—Denise L. F. Gromada
*Attorney, Agent, or Firm*—Arthur E. Fournier, Jr.

[57] ABSTRACT

A funnel-shaped arrangement (1) for drying and/or cooling vehicles or parts thereof. The funnel-shaped arrangement (1) is longitudinally divided into a number of sections each of which is provided with a plurality, preferably 60–250, of nozzles (7,20,21,22,23,24,25) which are substantially evenly distributed over the curved inner surface of the section and through which the gases are supplied and blown against the vehicle or the parts thereof passing through the arrangement (1), the pressure drop of the gases is measured across the nozzles (7,20,21,22,23,24,25) and the temperature of the gases before the nozzles (7,20,21,22,23,24,25). The measured pressure drop values are then compared with predetermined desired values corresponding to the prevailing temperature, whereupon a pressure increase or a pressure reduction signal is supplied to a first pressure changing means (29) for suplying the gases to the arrangement (1), depending on whether the measured values are below or above the desired values.

7 Claims, 2 Drawing Sheets

Figure 1:
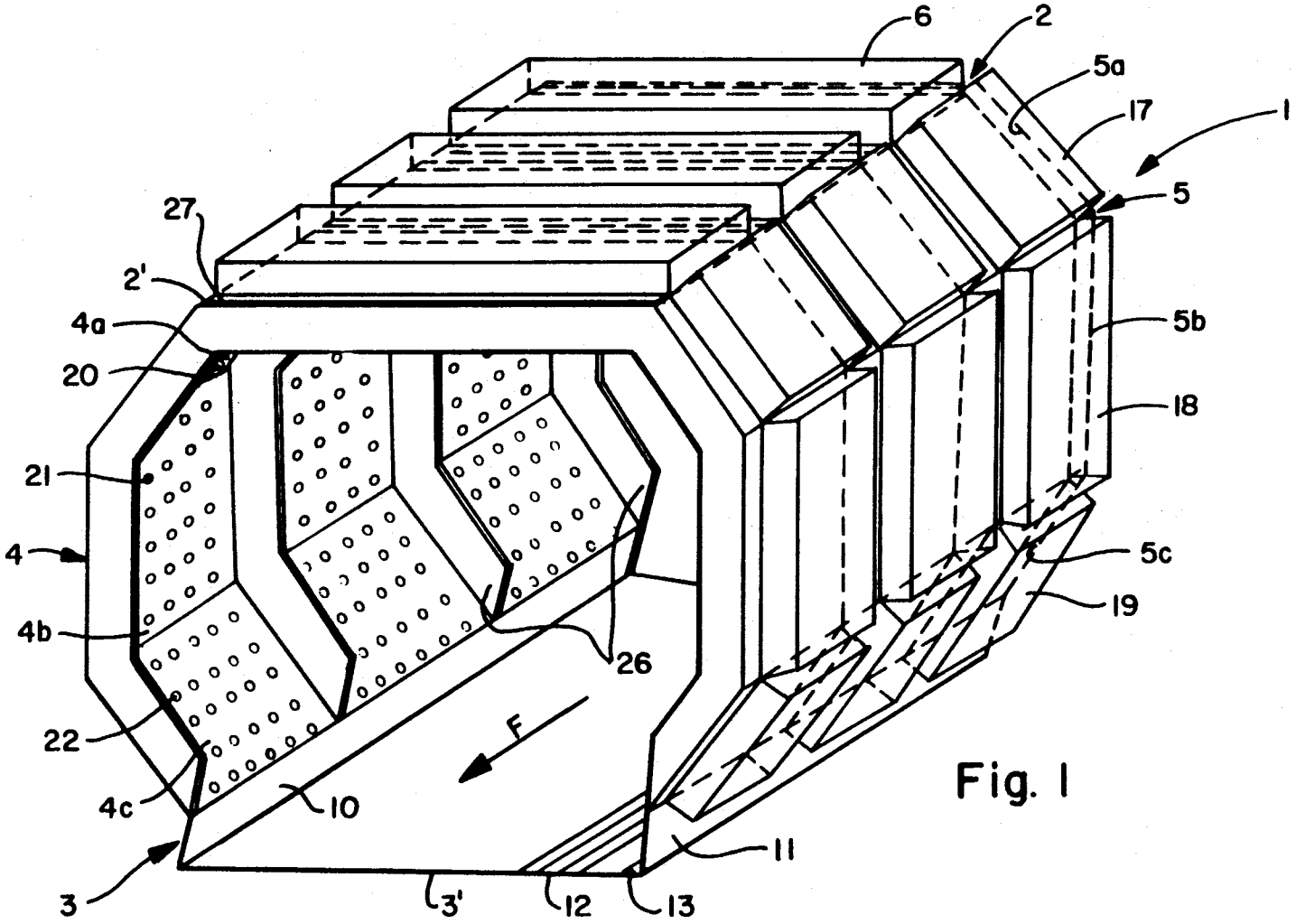

METHOD FOR CONTROLLING THE SUPPLY AND THE DISCHARGE OF HOT AIR TO AND FROM, RESPECTIVELY, A BLOWING TUNNEL

The present invention relates to a method for controlling the supply and the discharge of hot and/or cold gases to and from, respectively, a tunnel-shaped arrangement for drying and/or cooling vehicles or parts thereof, said arrangement being divided longitudinally into a number of sections each of which is provided with a plurality, preferably 60–250, of nozzles which are substantially evenly distributed over the curved inner surface of the section and through which the gases are supplied and blown against the vehicle or parts thereof passing through said arrangement.

In the car industry, there has been a switch over the past years to water-base paints, entailing certain problems in drying the paint on the vehicle parts. This is especially the case when a layer of non-water-base paint should be applied over a layer of water-base paint.

One problem of water-base paints is that these paints do not withstand such high temperatures as the paints previously used. This means that since it is desirable, for reasons of economy and efficiency, to use the same drying units (blowing tunnels) and the same throughput rates as earlier, it will be necessary to supply a larger amount of hot air per unit of time than earlier, to compensate for the necessary reduction of the temperature of the hot air. This, of course, places increased demands on the system supplying and discharging the hot air to and from the blowing tunnel.

Another problem is that, in order to meet the increasing demands for optimum energy utilisation, it is desirable to be able to control the supply of heat to the different parts of the blowing tunnel, so that there is supplied precisely the amount of heat necessary for drying, e.g., the different parts of a car body placed in the blowing tunnel.

Yet another problem when using water-base paints is that they give off water vapour when drying. This means that the exhaust air from the blowing tunnel will have a relatively high moisture content. If the moisture content inside the blowing tunnel becomes too high, the surface layer of the car body will dry very slowly. This means that recirculation of the exhaust air must be limited, although it is desirable for better energy economy to recirculate as much hot exhaust air as possible.

A further problem encountered when using water-base paints is that if the moist air forming during the drying of the paint in the blowing tunnel would leak out into the surrounding atmosphere at the ends of the blowing tunnel, there would be a risk both of condensation and, thus, of corrosion on objects, such as spray booths, placed around the blowing tunnel, and of impaired function in the spray booth. Nor is it of course desirable from energy aspects that the hot drying air is emitted directly into the surrounding atmosphere without any previous energy exchange with cold supply air.

If the blowing tunnel is used for drying an outer layer of enamel on a vehicle body, dangerous solvent vapours are instead emitted to the drying air within the blowing tunnel. Nor is it of course desirable that these vapours are emitted into the surrounding atmosphere.

The primary object of the present invention therefore is to provide a solution ensuring efficient supply of heat to the different parts of the blowing tunnel.

According to the invention, this object is achieved by a method of the type stated in the introduction to this specification, which is characterised by the steps of measuring the pressure drop of the gases across the nozzles, measuring the temperature of the gases before the nozzles, comparing the measured pressure drop values with desired values corresponding to the prevailing temperature, and supplying a pressure increase or a pressure reduction signal to first pressure changing means for supplying the gases to said arrangement, depending on whether the measured values are below or above said desired values.

The nozzles are suitably arranged in groups comprising a certain number of nozzles, preferably 15–90, and the pressure drop and the temperature of the gases can be measured, respectively, across and before each nozzle group or each nozzle.

The pressure drops and the temperatures measured, respectively, across and before the nozzle groups or the nozzles are suitably compared with predetermined desired values, whereupon such control signals are supplied to valve means arranged in conduits provided between said first pressure changing means and said nozzle groups or nozzles, that the opening degree of said valve means increases or decreases depending on whether the measured values are below or above said desired values.

Another object of the invention within the scope of this solution is to ensure that the hot drying air in the blowing tunnel and water- or solvent vapours contained therein do not flow out at the ends of the blowing tunnel into the surrounding atmosphere.

This object is achieved in that the pressure differences between the internal pressure of the arrangement and the pressure of the atmosphere surrounding the arrangement are measured, that the measured values are compared with predetermined desired values, and that for adjusting said pressure differences to said desired values, a pressure increase or a pressure reduction signal is supplied to second pressure changing means for discharging the gases from the interior of said arrangement, depending on whether the measured values are below or above said desired values.

Yet another object of the invention within the scope of this solution is to ensure that the air humidity within the blowing tunnel does not become too high while at the same time the exhaust air from the blowing tunnel is recirculated in a manner acceptable from energy aspects.

This object is achieved in that the moisture content of the gases is measured after said first pressure changing means, that the measured value is compared with a predetermined desired value, and that such a control signal is supplied to valve means arranged in a recirculation conduit provided between the suction side of said first pressure changing means and the delivery side of said second pressure changing means, that the opening degree of said valve means increases or decreases depending on whether the measured value is below and above said desired value.

The pressure changing means preferably consist of fans, and the speed and/or blade angles thereof are suitably modified as a function of said pressure increase and pressure reduction signals.

The invention will be described in more detail hereinbelow with reference to the accompanying drawings.

Figure 2:
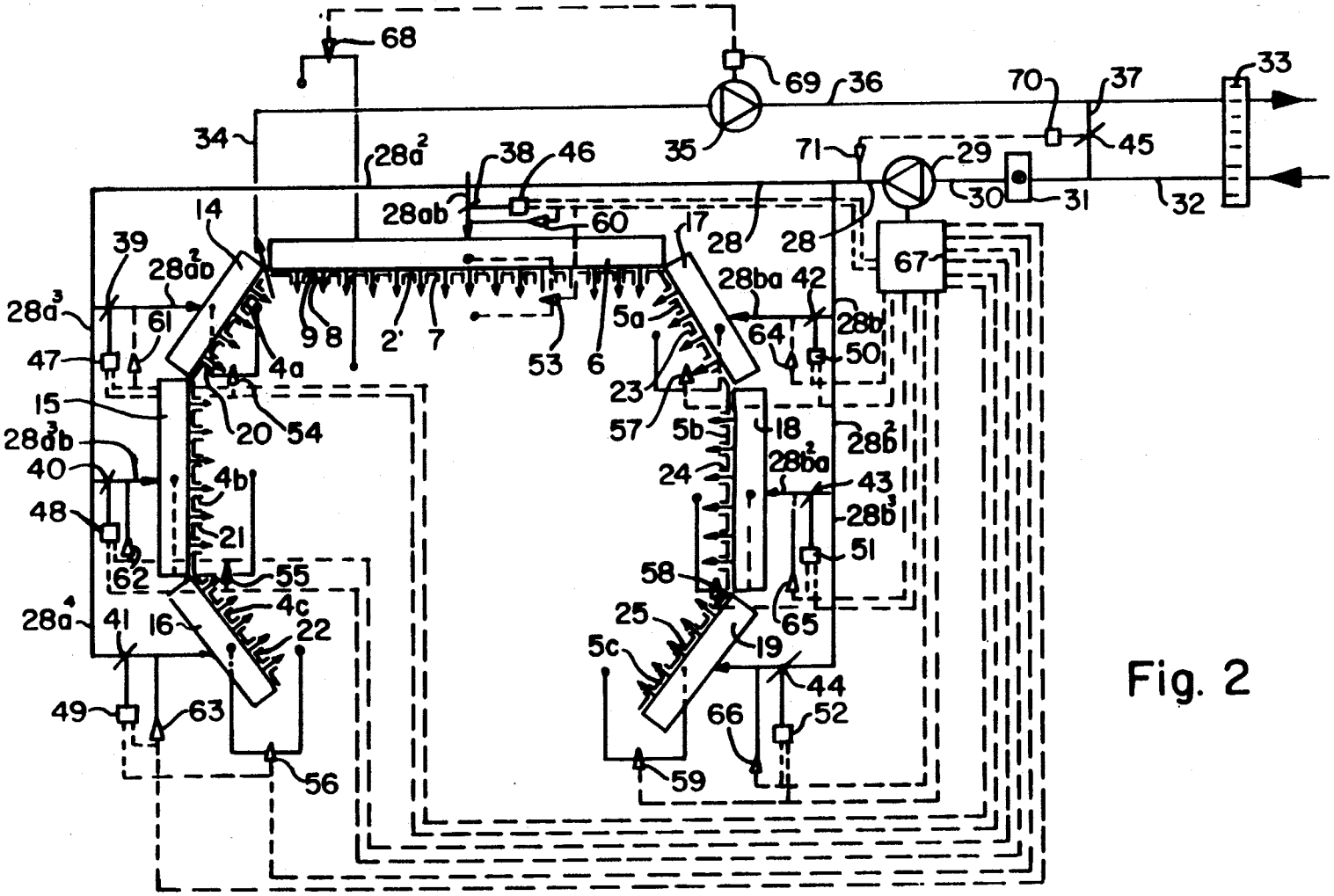

FIG. 1 schematically illustrates a blowing tunnel for drying vehicle parts, such as car bodies, the supply and discharge of hot air to and from the tunnel being controlled according to the method of the present invention; and FIG. 2 is a principle diagram of a control system for carrying out the method according to the present invention.

The blowing tunnel 1 shown in FIG. 1 has a top part 2, a bottom part 3, and two opposite side walls 4, 5.

The top part 2 consists of a planar top plate 2' provided externally with three blow boxes 6 and internally with nozzles 7 (see FIG. 2). The nozzles 7 are divided into groups, the nozzles in one and the same group communicating with a single blow box 6 via registering openings 8 and 9 provided, respectively, in the top plate 2' and in the side of the blow box facing the top plate 2'. Each group of nozzles comprises 30–90 nozzles, preferably 60.

The bottom part 3 consists of a bottom plate 3' and two side strips 10 and 11 connecting the bottom plate 3' to the side walls 4 and 5, respectively. Parallel to the side strip 11, the bottom plate is provided with a rail 12 serving as a guide rail for the left-hand pair of wheels of a transport truck (not shown). The truck is designed for transporting e.g. a newly-painted car body through the blowing tunnel 1 in the direction of the arrow F, the enamel on the car body being dried by the hot air in the blowing tunnel. The transport truck is pulled through the blowing tunnel by means of a chain 13.

The side walls 4 and 5 each consist of three planar side plates 4*a*, 4*b*, 4*c*, and 5*a*, 5*b*, 5*c*, respectively, which are joined longitudinally to each other and to the top plate 2' and the side strips 10 and 11 of the bottom plate 3' such that the cross-section of the blowing tunnel 1 has substantially the same shape as the cross-section of an ordinary car body. This means that the distance between the inner sides of the side plates and of the top plate and a car body located in the blowing tunnel will be approximately the same throughout the entire blowing tunnel.

The side plates 4*a*, 4*b*, 4*c* and 5*a*, 5*b*, 5*c* are each provided, like the top plate 2', externally with three blow boxes 14, 15, 16 and 17, 18, 19, respectively, and internally with nozzles 20, 21, 22 and 23, 24, 25, respectively (see FIG. 2). The nozzles are divided into groups (see FIG. 1), the nozzles in one and the same group communicating with a single blow box. This takes place through registering openings provided in the side plates and in the sides of the blow boxes facing the side plates. Each group of nozzles comprises 15–40 nozzles, preferably 30 (the nozzle groups of blow boxes 16 and 19), 36 (the nozzles groups of blow boxes 15 and 18) and 24 (the nozzle groups of blow boxes 14 and 17).

Further, the blowing tunnel 1 is divided longitudinally by means of four deflectors 26 provided along its inner periphery, into three sections which can be supplied with different flows of heat depending on the desired drying process. When a car body is located in the blowing tunnel, the deflectors 26 will cover about half the width of the space between the inner sides of the side plates and the outer side of the car body, whereby the deflectors can thus reduce the exchange of heat between the different sections. Since a deflector has also been provided at each of the ends of the blowing tunnel, the deflectors will also reduce the emission of heating into the atmosphere surrounding the blowing tunnel.

The blowing tunnel 1 is further provided with through ducts 27 for exhaust air which are so provided in the top plate 2' as to extend transversely on each side of each blow box 6 and the group of nozzles associated therewith. The exhaust ducts 27 open into a suction box (not shown) arranged around all the blow boxes 6 on the outer side of the top plate 2'.

As appears from FIG. 2, illustrating only the central one of the three sections of the blowing tunnel 1, the blow boxes 6; 14; 15; 16; 17; 18 and 19 are connected by conduits 28, 28*a*, 28*ab*; 28*a*$^2$, 28*a*$^2$*b*; 28*a*$^3$, 28*a*$^3$*b*; 28*a*$^4$; 28*b*, 28*ba*; 28*b*$^2$, 28*b*$^2$*a* and 28*b*$^3$, respectively, to a fan 29 for supplying hot air to the interior of the blowing tunnel 1 through the nozzles 7; 20; 21; 22; 23; 24 and 25. Further, the fan 29 is connected by a conduit 30 to an air preheater 31 connected in turn, by a conduit 32, to a heat exchanger 33.

The conduit 28 of course also branches off to the other two blowing-tunnel sections disposed on each side of the section shown in the Figure.

Further, the above-mentioned suction box is connected, by a conduit 34, to a fan 35 for discharging the air supplied to the interior of the blowing tunnel. The fan 35 is connected, by a conduit 36, to the heat exchanger 33 and, by a recirculation conduit 37, to the air preheater 31 via the conduit 32.

From FIG. 2 also appears that the conduits directly communicating with the blow boxes, i.e. conduits 28*ab*, 28*a*$^2$*b*, 28*a*$^3$*b*, 28*a*$^4$, 28*ba*, 28*b*$^2$*a* and 28*b*$^3$, are provided with throttles 38, 39, 40, 41, 42, 43 and 44, respectively. The recirculation conduit 37 is also provided with a throttle 45.

To control the opening degree of these throttles, as well as the speed of the fans, the drying installation described above is provided with a control system which will be described in more detail hereinbelow in connection with a description of the mode of operation of the drying installation.

Air from the atmosphere surrounding the drying installation is supplied to the heat exchanger 33 by means of a fan (not shown). This supply air is heated in the heat exchanger by that part of the exhaust air discharged from the interior of the blowing tunnel 1 which is not recirculated to the air preheater 31 via the recirculation conduit 37. From the heat exchanger the supply air, now partially heated, is conducted to the air preheater 31 where it is mixed with the recirculated exhaust air. This mixture of supply and exhaust air is heated in the air preheater to the desired temperature, whereupon it is passed to the fan 29 via the conduit 30.

The temperature to which the mixture is heated of course depends on what type of paint or enamel or other surface layer should be dried in the blowing tunnel, but it generally is in the range of 40°–250° C., preferably 50°–80° C.

The fan 29 supplies the air now heated to the blow boxes through the conduits associated therewith, The way in which the supplied air is distributed between the different blow boxes is determined by the opening degree of the throttles in the above-mentioned conduits. The opening degree of each throttle 38, 39, 40, 41, 42, 43 and 44 is adjusted by a control unit 46, 47, 48, 49, 50, 51 and 52, respectively, receiving measuring signals from a pressure drop sensor 53, 54, 55, 56, 57, 58 and 59, respectively, and a temperature sensor 60, 61, 62, 63, 64, 65 and 66, respectively. Each pressure drop sensor measures, for the air supplied to the associated blow box at the prevailing opening degree of the throttle concerned, the static pressure drop across the group of nozzles pertaining to the blow box, while the corresponding temperature sensor measures the temperature of this air before the blow box, but after the pertaining throttle.

Each control unit compares the measured pressure drop value with a desired value corresponding to the prevailing temperature. If the measured value is below the desired value, such a control signal is supplied to the pertaining throttle as to increase its opening degree. However, if the measured value is above the desired value, such a control signal is instead supplied to the throttle as to decrease its opening degree. If the measured value corresponds to the desired value, no control signal is supplied to the throttle.

Since the size of the flow of heat supplied by a certain group of nozzles is determined both by the temperature (measured by the temperature sensor) of the air passing through the group of nozzles, and by the flow of this air, in turn determined by the density of the air, the cross-sectional outlet area of the nozzles and the air velocity, determined by the static pressure difference (measured by the pressure drop sensor) across the group of nozzles, it is actually the flow of heat of the group of nozzles that is adjusted by means of the control unit for the throttle pertaining to the nozzle group. The size of the flow of heat for the air passing through a certain control unit thus is determined by the desired values of the associated control unit.

These desired values may, for instance, be changed from a control panel (not shown).

From this control panel it is also possible to act on the control units so as to supply a closing signal to the throttles. This may be useful e.g. in cases where only certain parts of the car body have been repainted. In this case, closing signals are supplied to all throttles whose associated nozzle groups are so disposed that, in operation, they would blow hot air onto non-repainted parts of the car body.

The total flow of air supplied to the blow boxes by the fan 29 is determined by the speed of the fan. The speed of the fan is adjusted by a control unit 67 receiving measuring signals from the above-described pressure drop sensors and temperature sensors (see FIG. 2). In the control unit 67, the pressure drop values measured by the sensors are compared in a conventional fashion with the desired values corresponding to the prevailing temperature. If the majority of the measured values are below the corresponding desired values, the control unit will supply such a control signal to the fan as to increase its speed. If, on the other hand, the majority of the measured values are above the corresponding desired values, the control unit will supply such a control signal to the fan as to decrease its speed. If the majority of the measured values correspond to the desired values, no control signal is supplied to the fan.

When an enameled or painted car body is being dried in the blowing tunnel, solvent vapours and water vapour, respectively, are emitted. For health reasons, these solvent vapours must not escape at the ends of the blowing tunnel into the surrounding atmosphere and, therefore, a negative pressure must be maintained in the blowing tunnel. Nor is it desirable from energy aspects that the hot drying air flows out into the surrounding atmosphere at the ends of the blowing tunnel (see the introduction to this specification). Also, since it is not desirable that unheated air from the surrounding atmosphere flows into the blowing tunnel at the ends thereof to cool the drying air in the tunnel, this negative pressure should thus be kept as small as possible.

In order to maintain such a pressure balance in the blowing tunnel, the pressure difference between the pressure in the blowing tunnel and the pressure of the surrounding atmosphere is continuously measured by means of a pressure sensor 68. This sensor supplies a measuring signal to a control unit 69 comparing the measured value with a predetermined desired value which is slightly below zero.

If the measured value is below the desired value, the control unit 69 supplies such a control signal to the fan 35 as to decrease its speed, whereby the flow of air discharged by the fan from the interior of the blowing tunnel 1 through the exhaust ducts 27, the suction box and the conduit 34 decreases, i.e. the pressure in the blowing tunnel increases. If the measured value is above the desired value, the control unit 69 supplies such a control signal to the fan 35 as to increase its speed, whereby the flow of air discharged from the interior of the blowing tunnel 1 increases, i.e. the pressure in the blowing tunnel decreases. If the measured value corresponds to the desired value, no control signal is supplied to the fan.

The fan 35 supplies part of the exhaust air discharged from the interior of the blowing tunnel, to the heat exchanger 31 via the recirculation conduit 37 and the remainder to the heat exchanger 33, from which the exhaust air, now cooled, is thereafter emitted into the surrounding atmosphere.

As pointed out above, a certain amount of water vapour is emitted to the air inside the blowing tunnel when drying water-base paints, which means an increase of the moisture content of the exhaust air. Since the surface layer of the car body dries slowly at too high a moisture content, this means that it is necessary to reduce the amount of exhaust air that is recirculated, despite the fact that the exhaust air has a higher energy content than the supply air delivered by the heat exchanger 33.

The amount of exhaust air to be recirculated is adjusted by means of a control unit 70 receiving a measuring signal from a moisture sensor 71. Since it is the moisture content of the air supplied to the blowing tunnel that is of importance, the moisture sensor 71 is so positioned as to measure the moisture content of the air after the fan, but before the conduit 28 branches off to the different blow boxes.

The control unit thereafter compares the measured value with a predetermined desired value. This desired value should be less than 0.03 kg water/kg air, preferably less than 0.02 kg water/kg air. If the measured value is below the desired value, the control unit supplies such a control signal to the throttle 45 of the recirculation conduit 37 as to increase its opening degree.

If the measured value is above the desired value, the control unit supplies such a control signal to the throttle 45 as to decrease its opening degree. If the measured value corresponds to the desired value, no control signal is supplied to the throttle. If the supply air has a moisture content exceeding the abovementioned desired value, it is preferably conducted through a dehumidifier (not shown) before being conducted into the heat exchanger 33.

The invention is of course not restricted to the embodiment described above, but may be modified in several different ways within the scope of the accompanying claims. For instance, the control units of the fans may adjust the blade angles of the fans instead of the speed of the fans, or these control units may instead control the fans indirectly by adjusting the opening degree of throttles or guide vanes provided before or behind the fans.

In the embodiment described above, the blowing tunnel has been supplied with hot air only, but it may of course also be supplied with cold air for cooling the car body before a new surface layer is to be applied to it. In such a case, air from the surrounding atmosphere is conducted directly into the fan 29 without passing through the heat exchanger 33 and the air preheater 31. If particularly cold air is required, the air can be conducted through an air cooler before being supplied to the fan.

The different sections of the blowing tunnel may of course be supplied with air that has been heated and/or cooled to different temperatures, the section through which the car body passes first then being generally supplied with the hottest air.

In order to prevent solvent vapours formed in the blowing tunnel from leaking out from the blowing tunnel at the ends thereof, it is possible, in addition to the above-mentioned negative pressure, also to create air locks at the ends of the blowing tunnel. The air supplied to the air locks often is a mixture of hot and cold air taken directly from the surrounding atmosphere. The air locks of course also prevent the hot air at the ends of the blowing tunnel from escaping into the surrounding atmosphere. This also ensures appropriate supply of heat to and, thus, adequate drying of the surface layer which has been applied to the front and rear portions of the car body The negative pressure in the blowing tunnel of course also prevents hot air and solvent vapours from leaving the blowing tunnel.

According to the embodiment described above, the pressure drop and the temperature are measured, respectively, across and before each group of nozzles, but if it is desirable to obtain a more accurate adjustment, the pressure drop and the temperature may of course be measured, respectively, across and before each nozzle.

I claim:

1. A method for controlling the supply and the discharge of gases to and from, respectively, a funnel-shaped arrangement (1) for treating equipment, said arrangement being divided longitudinally into a number of sections each of which is provided with a plurality of nozzles (7,20,21,22,23,24,25) which are substantially evenly distributed over the curved inner surface of the section and through which the gases are supplied and blown against the equipment passing through said arrangement, characterized by the steps of measuring the pressure drop of the gases across the nozzles (7,20,21,22,23,24,25), measuring the temperature of the gases before the nozzles, comparing the measured pressure drop values with desired values corresponding to the prevailing temperature, and supplying a pressure signal to first pressure changing means (29) for varying as required the supply of gases to said arrangement (1).

2. Method as claimed in claim 1, characterized in that the nozzles (7,20,21,22,23,24,25) are arranged in groups comprising a certain number of nozzles, and in that the pressure drop and the temperature of the gases are measured, respectively, across and before each group of nozzles.

3. Method as claimed in claim 1, characterized in that the pressure drop and the temperature of the gases are measured, respectively, across and before each nozzle (7,20,21,22,23,24,25).

4. Method as claimed in claim 1, characterized in that the pressure drops and the temperatures measured are compared with predetermined desired values, and in response to such comparison control signals are supplied to valve means (38,39,40,41,42,43,44) arranged in conduits (28*ab*,28*a*$^2$*b*,28*a*$^3$*b*,28*a*$^4$,28*ba*,28*b*$^2$*a*,28*b*$^3$) such that the opening degree of said valve means is modified as required in response to the receipt thereby of such control signals.

5. Method as claimed in claim 1, characterized in that the pressure differences between the internal pressure of the arrangement (1) and the pressure of the atmosphere surrounding said arrangement are measured, in that the measured values are compared with predetermined desired values, and in that for adjusting said pressure differences to said desired values a corrective pressure signal is supplied to second pressure changing means (35) for discharging the gases from the interior of said arrangement (1) as required.

6. Method as claimed in claim 1, characterized in that the moisture content of the gases is measured after said first pressure changing means (29), in that the measured value is compared with a predetermined desired value, and in response to such comparison a control signal is supplied as required to valve means (45) arranged in a recirculation conduit (37) provided between the suction side of said first pressure changing means (29) and the delivery side of a second pressure changing means (35) such that the opening degree of said valve means is modified as required in response to the receipt thereby of such a control signal.

7. Method as claimed in claim 6, characterized in that said pressure changing means are fans (29,35) and in that the operating conditions of the fans (29,35) are modified as a function of the control signal received thereby.

* * * * *